United States Patent [19]

della Porta et al.

[11] 4,137,012

[45] Jan. 30, 1979

[54] MODULAR GETTER PUMPS

[75] Inventors: Paolo della Porta; Bruno Ferrario; Livio Rosai, all of Milan, Italy

[73] Assignee: S.A.E.S. Getters S.p.A., Milan, Italy

[21] Appl. No.: 840,243

[22] Filed: Oct. 7, 1977

[30] Foreign Application Priority Data

Nov. 3, 1976 [IT] Italy ..... 29004 A/76
Mar. 9, 1977 [IT] Italy ..... 21075 A/77

[51] Int. Cl.[2] ..... F04B 37/02
[52] U.S. Cl. ..... 417/51
[58] Field of Search ..... 417/48, 49, 51; 313/174, 178, 180

[56] References Cited

U.S. PATENT DOCUMENTS

| | | | |
|---|---|---|---|
| 3,609,064 | 9/1971 | Giorgi et al. | 417/51 |
| 3,620,645 | 11/1971 | Porta et al. | 417/48 X |
| 3,662,522 | 5/1972 | Porta et al. | 417/51 X |
| 3,780,501 | 12/1973 | Porta et al. | 417/51 X |
| 3,961,897 | 6/1976 | Giorgi et al. | 417/51 X |
| 4,050,914 | 9/1977 | Murphy | 417/51 X |

*Primary Examiner*—William L. Freeh
*Assistant Examiner*—Edward Look
*Attorney, Agent, or Firm*—Littlepage, Quaintance, Murphy, Richardson and Webner

[57] ABSTRACT

A modular getter pump includes a first and a second supporting electrode. At least one strip of high ohmic resistance material is connected to and supported by the first and second supporting electrodes. The strip of high ohmic resistance material has a length much greater than its width and only a nominal thickness and is pleated into flat substantially parallel zones which are uniformly separated from each other. The pleated strip forms a substrate having a non-evaporable getter metal at least partially embedded therein. A rod means is orthogonally positioned with respect to the width of the pleated strip for maintaining the separation between adjacent parallel zones. Such modular getter pumps can be used singularly or in a multiple array to sorb gases in closed vessels such as, for example, fusion reactors, particle accelerators, storage rings, neutral beam injectors, and others.

22 Claims, 8 Drawing Figures

MODULAR GETTER PUMPS

BACKGROUND OF THE INVENTION

1. Field of the Invention

The present invention relates to an improved getter pump of the modular type employing non-evaporable getter materials embedded in a substrate. A modular getter pump according to this invention is particularly suitable for use either alone or as a multiple array in order to sorb gases in closed containers in which it is desirable to produce and maintain a high vacuum.

2. Description of the Prior Art

Getter pumps employing non-evaporable getter materials embedded in a substrate are known and have found wide acceptance for producing and maintaining vacuums in closed vessels. See for example U.S. Pat. Nos. 3,609,062; 3,662,522; and 3,780,501. In particular, getter pumps employing a substrate of high ohmic resistance and a non-evaporable getter material embedded in the substrate have been described in U.S. Pat. No. 3,609,064. Such getter pumps usually employ a substrate in the form of a long ribbon, previously coated with non-evaporable getter metal particles as described in U.S. Pat. No. 3,652,317. The long ribbon is then folded repeatedly backwards and forwards to form a pleated substrate which is then disposed radially about a central axis. A resistance heater is frequently provided in coincidence with said central axis.

Even when a separate heater is not provided, as in the case of a getter pump comprising a substrate of high ohmic resistance, the preferred form of a substrate is a pleated strip. See for example Column 1, Line 60, and FIGS. 1 and 2 of U.S. Pat. No. 3,609,064. Unfortunately, such devices suffer from a number of disadvantages. The presence of the necessary separate resistance heater increases production costs. Uniform heating of the getter metal is difficult if not impossible to obtain since various portions of the coated substrate are at varying distances from the separate resistance heater. Furthermore, a separate heater is inefficient due to excessive heat loss to parts which are not intended to be heated thus wastefully increasing the power requirements of the getter pump.

Furthermore, if a large surface area has to be rendered capable of sorbing gases, then it becomes cumbersome to cover this entire surface area with prior art non-evaporable getter pumps.

Another method of pumping unwanted gases is by causing them to condense on panels cooled to cryogenic temperatures. However, this involves the use and handling of expensive cryogeni liquids. Very often, the cooled surfaces have to be shielded by chevron baffles or the like, to prevent re-evaporation of condensed gases, and screened against evergetic particle bombardment. Such baffles can undesirably limit the pumping speed of the panel. Moreover, cryogenic pumps, if exposed to a pressure increase caused by system leaks or failure, can abruptly desorb previously sorbed gases, thus leading to production of an explosive air-hydrogen mixture. Constraints are placed on the spacial orientation of the condensation panels imposed by the fact that the cryogenic coolant is a liquid.

Accordingly, it is an object of the present invention to provide a getter pump which required no separate heater, thus reducing the power requirements and cost of the pump. Still another object is to provide a getter pump which can be assembled to cover large surface areas and be capable of replacing cryogenic pumping units. A further object is to provide modular getter pumps which can be placed together to conform to the interior surface of a vacuum vessel in any desired spacial orientation.

SUMMARY OF THE INVENTION

These objects of the present invention are generally satisfied by providing a modular getter pump having a first and a second supporting electrode to which is connected at least one strip of high ohmic resistance material, the strip having a length much greater than its width and only a nominal thickness. The strip is pleated into a plurality of flat substantially parallel zones which are uniformly separated from each other. The pleated strip constitutes a substrate having a non-evaporable getter metal at least partially embedded therein. A rod means is orthogonally positioned with respect to the width of the pleated strip for maintaining the separation between adjacent parallel zones. The maintenance of separation between adjacent parallel zones ensures a high pumping speed. Generally, the rod means comprises an insulated bar fixed at its extremities to the electrodes which support the pleated substrate. In one particular embodiment, the rod means includes a biasing means for maintaining the flat parallel zones under tension. In another embodiment, the rod means passes perpendicularly through said flat parallel zones and includes annular insulated spacer elements situated between adjacent parallel zones and contiguously surrounding the insulated bar.

Generally, a modular getter pump of the present invention has been found to perform adequately when the ratio of separation distance between adjacent flat parallel zones to strip width is between 1/6 and 1/60, while the preferred ratio is between 1/10 and 1/30. Superior performance has been found to result from using a substrate having a resistivity of between 5 and 150 micro-ohm-centimeters when measured at 20° C. Examples of suitable substrate materials include, among others, stainless steel containing 18% chromium and 8% nickel, the balance consisting essentially of iron; as well as the widely used high resistance material available under the trade name "Nichrome". Other suitable materials will be apparent to those skilled in the art. "Constantan" or titanium are particularly useful if a non-magnetic substrate is required.

In the broadest aspects of the present invention, any non-evaporable getter material can be employed, such as titanium, zirconium, tantalum, or niobium, as well as alloys and/or mixtures of two or more of the above or with other metals that do not materially reduce their sorptive capacity. An example of such an alloy is $Zr_2Ni$. Rare earth metals and yttrium can also be used. The preferred non-evaporable getter material is an alloy of 5 to 30 weight percent aluminum, the balance zirconium. An especially effective alloy is that of 16 weight percent aluminum, the balance zirconium, which is available as "St 101" from SAES Getters, Milan, Italy.

While a modular getter pump of the present invention may be used singularly, a plurality of such modular pumps may be placed side by side to cover, for instance, the internal wall of a vacuum vessel. They may be electrically connected either in parallel or series, depending upon the conditions of electrical potential or current which can be tolerated within the vacuum vessel. When an electric current is applied to the high electrical resistance substrates, the passage of current through the substrate heats the gettering material incorporated therein to the desired temperature for initial activation and to its operating temperature.

Particular features and distinct advantages of the present invention will become apparent to those of ordinary skill in the art upon examination of the following description of preferred embodiments when considered in conjunction with the accompanying figures.

DESCRIPTION OF PREFERRED EMBODIMENTS

Figure 1:
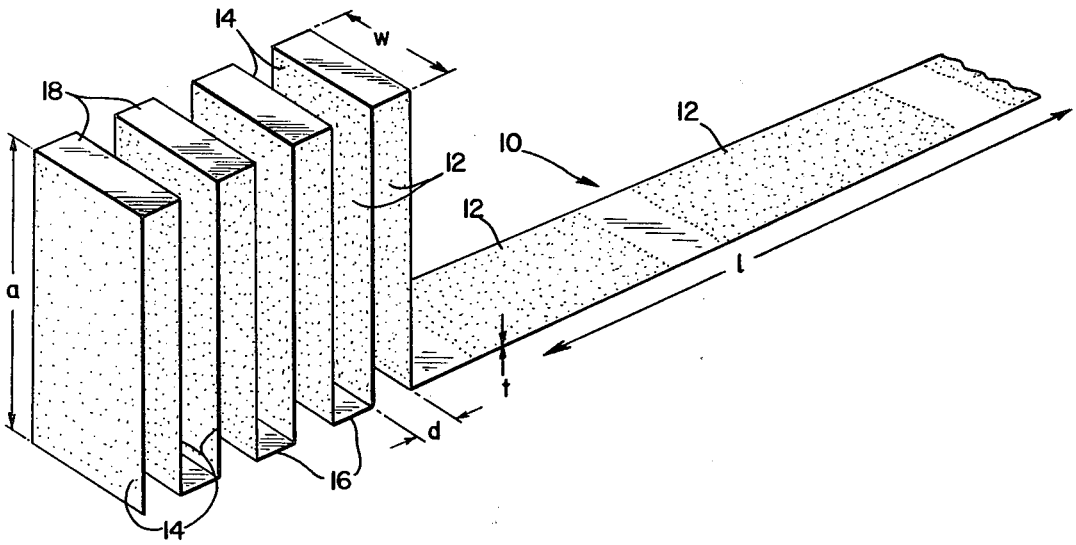
FIG. 1 is a perspective view of a strip type substrate used in a modular getter pump according to this invention, partially pleated into a plurality of flat substantially parallel zones.

A modular getter pump according to the present invention incorporates a strip 10 of high ohmic resistance material, the strip 10 having a length L much greater than its width w and of a nominal thickness t. The strip 10 includes a non-evaporable getter metal 12 at least partially embedded on one or both surfaces of the strip 10. The strip 10 is pleated into a plurality of flat, substantially parallel zones 14 separated by a uniform distance d. Two sets of bridging zones 16 and 18 link the parallel zones 14 together to form the continuous strip 10. While the getter metal 12 can be applied continuously along the length of the strip, it can also be selectively applied as illustrated in FIG. 1 so that the resulting pleated strip is free from getter metal at each fold line.

Figure 2:
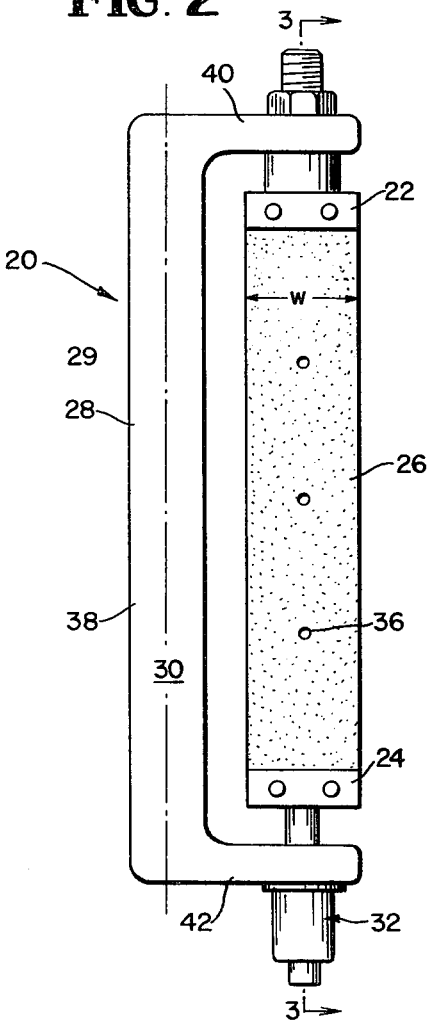
FIG. 2 is an elevation view of one embodiment of a modular getter pump according to this invention employing a pleated substrate as shown in FIG. 1.
Figure 3:
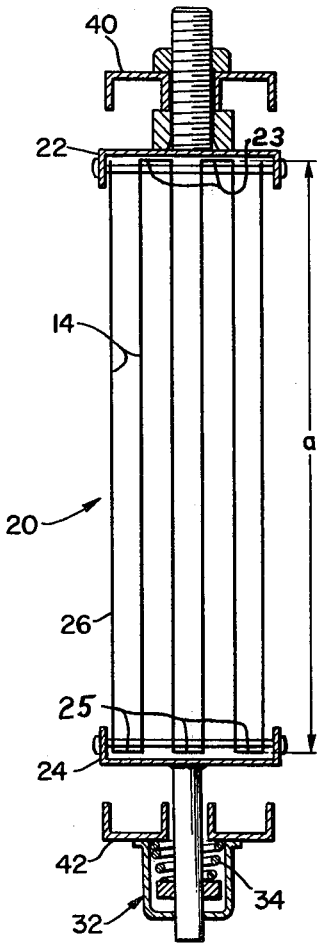
FIG. 3 is a sectional view of the modular getter pump shown in FIG. 2 taken along Line 3—3.

In a first preferred embodiment illustrated in FIGS. 2 and 3, a modular getter pump 20 according to this invention comprises a first supporting electrode 22 and a second supporting electrode 24. A pleated substrate 26 of high ohmic resistance as previously described is attached to the supporting electrodes 22 and 24. The first electrode 22 supports a first set of bridging zones 23 of the pleated strip 26 while the second electrode 24 supports a second set of bridging zones 25 opposite the first set. A rod means 28 is positioned such that the axis 29 of the rod means 28 is orthogonal to the width vector w of the pleated strip for maintaining the separation between adjacent parallel zones. The rod means 28 comprises an insulated bar 30 fixed at its extremities to the supporting electrodes 22 and 24. A biasing means 32 is included for maintaining the flat parallel zones under tension. As illustrated in FIG. 3, the biasing means 32 comprises an expansion spring 34 attached to supporting electrode 24. The substrate 26 can be provided with the stress relief holes 36 to insure even expansion of the substrate 26 upon heating, or mechanically increase the substrate's electrical resistance.

The rod means 28 illustrated in FIG. 2 comprises a frame 38 provided with two support arms 40 and 42 to which are attached the supporting electrodes 22 and 24. The biasing means 32 maintains the substrate 26 in tension even when the substrate expands due to heating caused by the passage of electric current through the substrate. Thus, the rod means maintains the separation between adjacent parallel zones, thereby ensuring the desired exposure to the volume of gas sought to be pumped.

In operation, one or more of the modular getter pumps 20 are attached to the interior of a vessel to be evacuated by any suitable means. The vessel is then evacuated by any convenient means such as a mechanical pump or other vacuum pumps well known in the art. The electrodes 22 and 24 are connected to a source of alternating or direct current whereby current flows through the planar substrates 26 ohmically generating heat in the substrate and activating the getter material embedded therein causing it to become capable of sorbing gases into the interior of each particle of getter material. Current is passed through the planar substrates 26 such that the temperature of the getter material 12 is held for between 5 minutes to a few hours at between 600° C. and 900° C., and preferably between 700° C. and 800° C., to activate the getter material. Once activation is accomplished, the getter material 12 is gas sorptive at room temperature but the rate of gas sorption and capacity can be increased by heating the getter material 12 as described above or more preferably at temperatures of between 200° and 400° in order to have a sufficiently high hydrogen sorption speed and sufficiently low equilibrium pressure.

By way of example, finely ground "St 101" non-evaporable getter material which has passed through a screen having 140 mesh per inch and has been retained on a screen having 600 mesh per inch is at least partially embedded into a Constantan substrate having a nonimal thickness t of about 0.2 mm using the method described in U.S. Pat. No. 3,652,317. This substrate strip is then used to form a modular getter pump as illustrated in FIGS. 1-3 of the present disclosure with an amplitude, a, of 50 centimeters and a width, w, of 5 centimeters. The parallel separation, d, between each of the planar substrates 26 is 0.5 centimeters.

Ten of the modular getter pumps as previously described are placed in the outer vacuum shell of a torus type fusion machine which is pumped down to less than $10^{-6}$ torr by mechanical pumps. Current is passed through the substrates to heat the getter material to 750° C. for 15 minutes, then the current is reduced until the temperature of the substrates reaches 200° C. The vacuum level is maintained at less than $10^{-6}$ torr by the modular getter pumps. The modular getter pumps as described successfully replace cryogenic pumping panels in the pumping system of the torus of the experimental fusion machine as previously described. In another test, an array of modular getter pumps constructed as illustrated in FIGS. 2 and 3 are mounted on the internal free surfaces of a neutral beam injector of an experimental fusion machine. They successfully provide a high pumping efficiency and allow the maintenance of a high neutral particle through-put into the torus while maintaining the injector pressure gradient within working limits.

Figure 4:
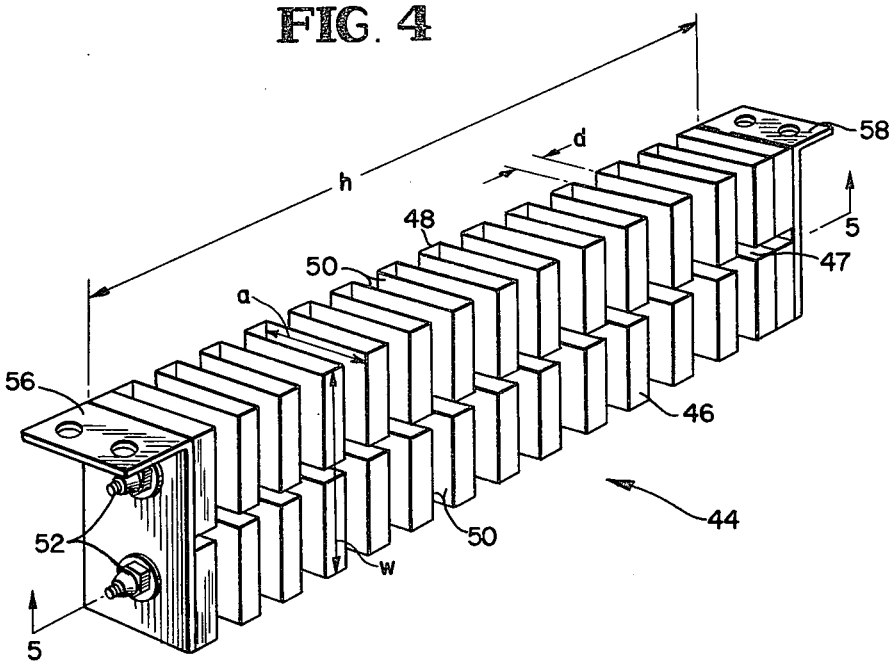
FIG. 4 is a perspective view of an alternative embodiment of a modular getter pump according to this invention.
Figure 5:
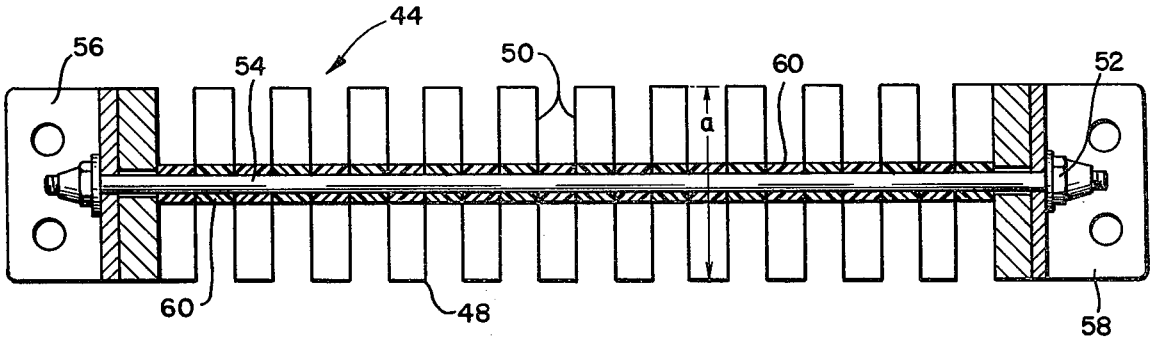
FIG. 5 is a sectional view of the modular getter pump illustrated in FIG. 4 taken along Line 5—5.

A second preferred embodiment of a modular getter pump according to this invention is illustrated in FIG. 4 and FIG. 5. The modular getter pump 44 employs a pair of strips 46 and 48 each of which are constructed as previously described and illustrated in FIG. 1. The substrates of the strips 46 and 48 are generally formed of a material having a resistivity of from 1 to 200 and preferably from 5 to 150 micro-ohm-centimeters when measured at 20° C. The strips 46 and 48 of substrates have a non-evaporable getter metal at least partially embedded therein and then are pleated into a plurality of substantially parallel zones 50 which are uniformly separated from each other by a distance, d, thereby reducing the overall linear dimension, h, of the getter pump. Rod means 52 is orthogonally positioned with respect to the width, w, of the pleated strips for maintaining the separation, d, between adjacent parallel zones 50. The rod means 52 comprises a pair of insulated bars 54 fixed at their extremities to a pair of supporting electrodes 56 and 58. The insulated bars 54 pass perpendicularly through the flat parallel zones 50. As is more clearly illustrated in FIG. 5, the rod means 52 includes a plurality of annular insulating spacer elements 60 situated between adjacent parallel zones 50 and contiguously surrounding the insulating bars 54.

The modular getter pump illustrated in FIGS. 4 and 5 has been found to have additional advantages to that illustrated in FIGS. 2 and 3. Because of thermal relaxation of possible stresses, induced into the substrate 10 during the getter material coating process, or due to non-uniform tensions due to non-uniform clamping at the extremities of the modular getter pumps shown in FIGS. 2 and 3, the elongated substrates 26 deform somewhat following heating so as to be no longer quite parallel with each other in some circumstances. While it is possible to largely correct this error by increasing the strength of the tensioning means 32, it has been found that superior performance with only minimum warping due to thermal relaxation is achievable by using the structure illustrated in FIGS. 4 and 5. It will be appreciated that, in order that the heating current pass through the pleated substrate, the bars 54 must be insulated electrically from electrodes 56 and 58 if the bars 54 are made of a conducting material. A first and a last of the parallel zones 50 of pleated strips 46 and 48 are electrically connected with the first and second supporting electrodes 56 and 58 respectively.

A modular getter pump as illustrated in FIGS. 4 and 5 can be used singularly or can be placed together with other similar modules, for example, side by side, in order to cover, for example, the internal walls of a vacuum vessel. When modular getter pumps of this type are grouped together in panels, the electrical connections between the various pump modules can be in parallel or in series according to the conditions of electrical potential which can be tolerated within the vacuum vessel.

Figure 6:
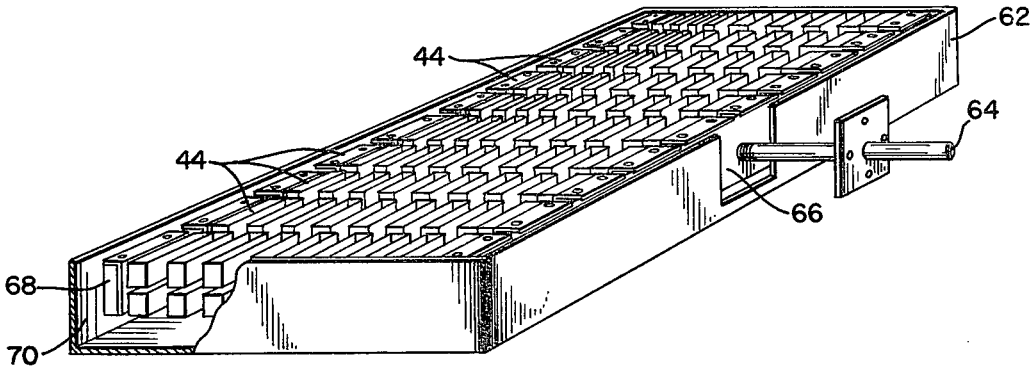
FIG. 6 is a perspective view of a panel employing a plurality of the modular getter pumps illustrated in FIG. 4.

In FIG. 6, there is illustrated a panel 62 comprising a multiplicity of modular getter pumps 44 whose power supply is provided by a single current inlet electrode 64. During operation, one or more modular getter pumps 44 together with one or more panels 62 are connected together in parallel or series according to the power requirements by means of bus bars 66 and 68 situated in the wall 70 of panel 62. The vessel containing the modular getter pumps can be evacuated by any suitable means such as, for example, a mechanical pump, or other vacuum pump known in the art. The two bus bars 66 and 68 are then connected to an alternating current power supply or a direct current power supply so that the current flows through the module strips 46 and 48 of each module 44 generating heat by electrical resistance and activating the getter material as previously described.

Figure 7:
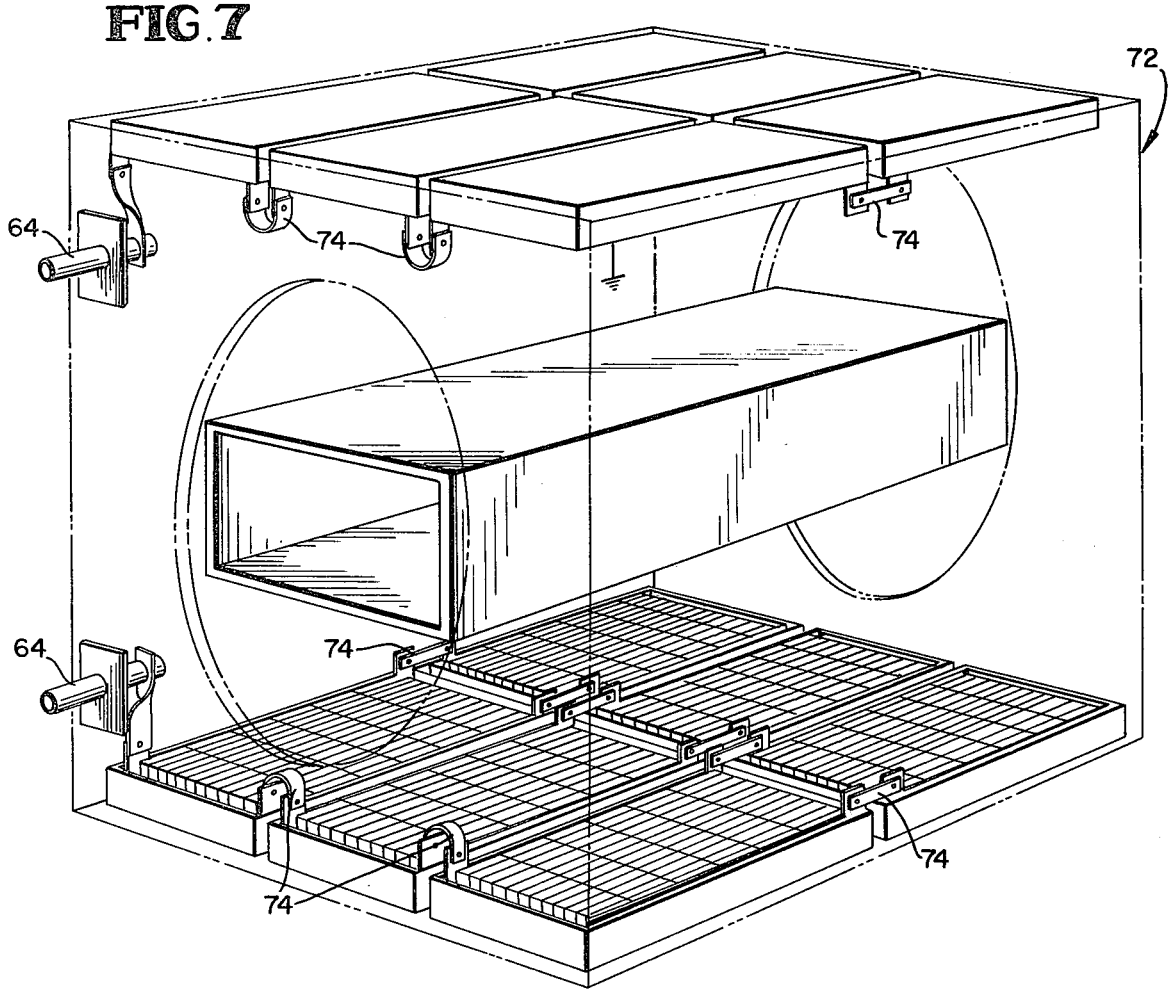
FIG. 7 is a perspective view of a vacuum enclosure employing a plurality of the panels illustrated in FIG. 6.

FIG. 7 illustrates a vacuum container 72 containing a plurality of panels 62 approximately situated such that the bus bars may be joined by jumpers 74 and the panels ultimately connected to electrical input electrodes 76.

An important characteristic of the modular getter pump of the present invention is the ratio of the distance between parallel zones of the substrate, d, and their width, w, the ratio being d/w. In the case of the embodiment illustrated in FIGS. 4 and 5 where a pair of strips 46 and 48 are mounted width-wisely adjacent, the parameter, w, can be considered to be equal to the total width of the two strips including the intermediate gap 47 provided the gap does not contribute more than about 10% of the total width.

Figure 8:
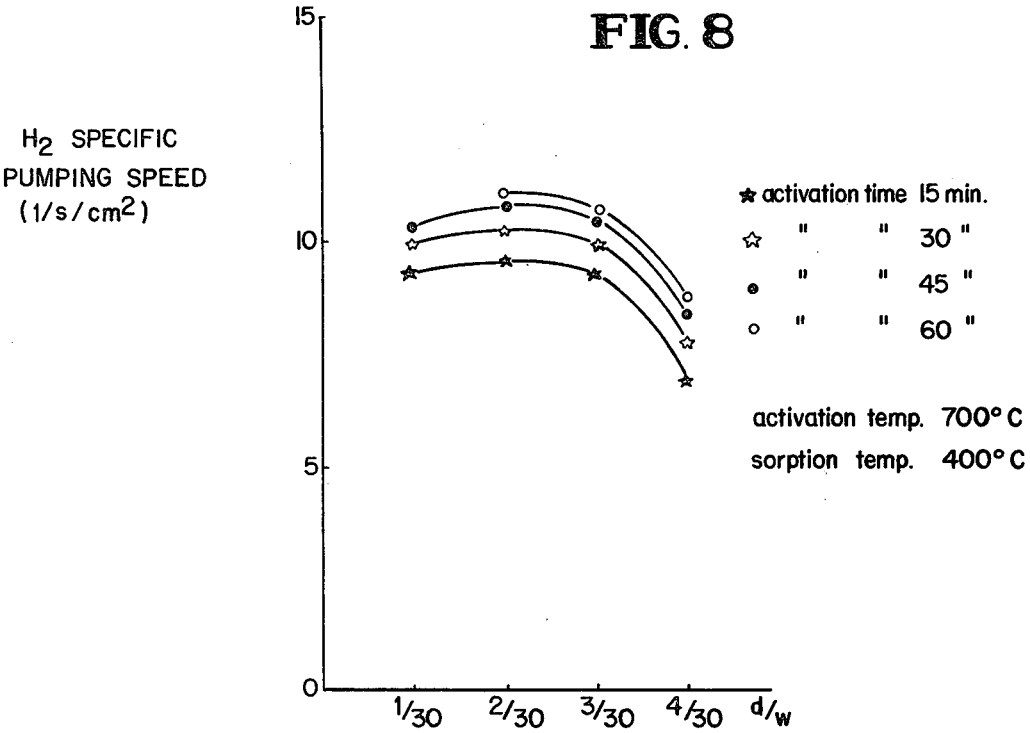
FIG. 8 is a graph showing the hydrogen pumping speed per unit of exposed area of a getter module according to this invention versus the d/w ratio at different activation times.

Referring now to FIG. 8, there are indicated several values of the pumping speed in liters per second for hydrogen per square centimeter of exposed surface area of the modular getter pump, when only one side of the getter module was exposed, as a function of the ratio d/w. These experimental results were obtained using a length of substrate of about 20 zones in the configuration shown in FIGS. 4 and 5, and assembled into a panel as shown in FIG. 6. As can be seen from the resulting graph, the largest pumping speeds are obtained when the ratio d/w is between 1/60 and 1/6, and preferably between 1/30 and 1/10.

Although the invention has been described in detail with reference to certain preferred embodiments thereof, it will be understood that variations and modifications can be effected within the spirit and scope of the invention as described above and as defined in the appended claims.

What is claimed is:

1. A modular getter pump comprising:

(1) a first and a second supporting electrode, (b) at least one strip of high ohmic resistance material connected to and supported by the first and second supporting electrodes, the strip having a length much greater than its width and a nominal thickness, the strip being pleated into flat substantially parallel zones which are uniformly separated from each other thereby reducing the effective length of the strip, the pleated strip forming a substrate having a non-evaporable getter material at least partially embedded therein, and (c) rod means orthogonally positioned with respect to the width of the pleated strip for maintaining the separation between adjacent parallel zones.

2. The modular getter pump of claim 1 wherein said rod means comprises an insulated bar fixed at its extremities to said supporting electrodes and biasing means for maintaining said flat parallel zones under tension.

3. The modular getter pump of claim 2 wherein said first electrode supports a first set of bridging zones of the pleated strip located between adjacent pairs of parallel zones and wherein said second electrode supports a second set of bridging zones of the pleated strip opposite said first set.

4. The modular getter pump according to claim 2 wherein said biasing means is an expansion spring attached to one of said supporting electrodes.

5. The modular getter pump of claim 2 wherein said pleated strip contains stress relief holes.

6. The modular getter pump of claim 1 wherein said rod means comprises an insulated bar fixed at its extremities to said supporting electrodes and passing perpendicularly through said flat parallel zones.

7. The modular getter pump of claim 6 wherein a first and a last of said flat parallel zones of said pleated strip are electrically connected with said first and second supporting electrodes respectively.

8. The modular getter pump of claim 6 wherein said rod means further comprises annular insulating spacer elements situated between adjacent parallel zones and contiguously surrounding said insulated bar.

9. The modular getter pump according to claim 1 wherein the ratio of separation distance between adjacent flat parallel zones to strip width is between 1/6 and 1/60.

10. The modular getter pump of claim 9 wherein said ratio is between 1/10 and 1/30.

11. The modular getter pump of claim 1 wherein the pleated strip is free from getter material at each fold line.

12. The modular getter pump of claim 1 wherein said pleated strip has a resistivity of from 5 to 150 microohm-centimeters when measured at 20° C.

13. The modular getter pump of claim 1 wherein said non-evaporable getter metal is an alloy of 5 to 30 weight percent aluminum, the balance zirconium.

14. The modular getter pump of claim 13 wherein said non-evaporable getter metal contains 16 weight percent aluminum, the balance zirconium.

15. A modular getter pump comprising:

(a) a first and a second supporting electrode, (b) at least one strip of high ohmic resistance material connected to and supported by the first and second supporting electrodes, the strip having a length much greater than its width and a nominal thickness, the strip being pleated into flat substantially parallel zones which are uniformly separated from each other thereby reducing the effective length of the strip, the pleated strip forming a substrate having a non-evaporable getter material at least partially embedded therein, and (c) rod means orthogonally positioned with respect to the width of the pleated strip for maintaining the separation between adjacent parallel zones, the rod means comprising an insulated bar fixed at its extremities to said supporting electrodes and biasing means for maintaining said flat parallel zones under tension.

16. The modular getter pump of claim 15 wherein said first electrode supports a first set of bridging zones of the pleated strip located between adjacent pairs of parallel zones, wherein said second electrode supports a second set of bridging zones of the pleated strip opposite said first set, and wherein said biasing means is an expansion spring attached to one of said supporting electrodes.

17. A modular getter pump comprising:

(a) a first and a second supporting electrode, (b) at least one strip of high ohmic resistance material connected to and supported by the first and second supporting electrodes, the strip having a length much greater than its width and a nominal thickness, the strip being pleated into flat substantially parallel zones which are uniformly separated from each other thereby reducing the effective length of the strip, the pleated strip forming a substrate having a non-evaporable getter material at least partially embedded therein, and (c) rod means orthogonally positioned with respect to the width of the pleated strip for maintaining the separation between adjacent parallel zones, the rod means comprising an insulated bar fixed at its extremities to said supporting electrodes and passing perpendicularly through said flat parallel zones, and a plurality of annular insulating spacer elements situated between adjacent parallel zones and contiguously surrounding said insulated bar.

18. The modular getter pump of claim 17 wherein a first and a last of said flat parallel zones of said pleated strip are electrically connected with said first and second supporting electrodes respectively.

19. A pumping panel comprising a multiplicity of modular getter pumps connected electrically to each other, each modular getter pump comprising:

(a) a first and second supporting electrode, (b) at least one strip of high ohmic resistance material connected to and supported by the first and second supporting electrodes, the strip having a length much greater than its width and a nominal thickness, the strip being pleated into flat substantially parallel zones which are uniformly separated from each other thereby reducing the effective length of the strip, the pleated strip forming a substrate having a non-evaporable getter material at least partially embedded therein, and (c) rod means orthogonally positioned with respect to the width of the pleated strip for maintaining the separation between adjacent parallel zones, the ratio of separation to width being between 1/60 and 1/6.

20. A pumping panel according to claim 19 wherein the ratio of separation of width is between 1/30 and 1/10 and the width is measured so as to include any gap existing between width-wise adjacent strips provided that the gap contributes less than 10% to the width measure.

21. A vacuum container comprising at least one modular getter pump, the modular getter pump comprising:

(a) a first and a second supporting electrode, (b) at least one strip of high ohmic resistance material connected to and supported by the first and second supporting electrodes, the strip having a length much greater than its width and a nominal thickness, the strip being pleated into flat substantially parallel zones which are uniformly separated from each other thereby reducing the effective length of the strip, the pleated strip forming a substrate having a non-evaporable getter material at least partially embedded therein, and (c) rod means orthogonally positioned with respect to the width of the pleated strip for maintaining the separation between adjacent parallel zones such that the separation to width ratio is between 1/60 and 1/6.

22. The vacuum container of claim 21 wherein said at least one modular getter pump is positioned in a pumping panel containing a multiplicity of said modular getter pumps connected electrically to each other.

* * * * *